United States Patent [19]

Beckman, Jr.

[11] 4,083,322

[45] Apr. 11, 1978

[54] FUSER WICK

[75] Inventor: Maynard K. Beckman, Jr., Plano, Tex.

[73] Assignee: Xerox Corporation, Stamford, Conn.

[21] Appl. No.: 675,371

[22] Filed: Apr. 9, 1976

[51] Int. Cl.[2] ..... B05C 11/00; B05C 13/00; B05C 13/02

[52] U.S. Cl. ..... 118/70; 118/260; 118/60

[58] Field of Search ..... 118/60, 70, 260; 432/60, 228, 59

[56] References Cited

U.S. PATENT DOCUMENTS

| | | | |
|---|---|---|---|
| 3,291,466 | 12/1966 | Aser et al. | 432/228 X |
| 3,718,116 | 7/1971 | Thettu | 432/228 UX |
| 3,861,861 | 1/1975 | Thettu | 432/59 |

*Primary Examiner*—Ronald Feldbaum

[57] ABSTRACT

A heated pressure roll fuser system is provided with a wick assembly which comprises a Nomex layer of material, a wool layer of material and a porous wiper pad. The wiper pad engages a heated fuser roll. One face of one end of the Nomex layer contacts the wiper pad, and the same face at the other end of the Nomex layer engages an oil applicator roll which rotates in an oil reservoir laterally spaced from the fuser roll. The wool layer is on top of the Nomex layer and engages the other face thereof. Both the Nomex layer and the wool layer wick oil to the wiper pad where oil passes by gravity through the wiper pad to the fuser roll. The wicking action of the wool layer assures a continuous supply of oil at the fuser roll on long copy runs of a xerographic machine in which it is utilized. The Nomex layer protects the wool from scorching.

3 Claims, 3 Drawing Figures

FUSER WICK

DESCRIPTION OF THE INVENTION

This application relates to a wick for incorporation into a fuser system utilized for fixing zerographic toner particles to a sheet of paper or other surface to form a permanent print. One typical device for fixing the toner particles to the backing sheet is by a heated pressure fuser roll system in which a copy sheet is passed through the nip of a Teflon-coated heated fuser roll and a backup roll. In such fusing systems, care must be taken to remove unwanted toner particles from the heated fuser roll prior to its contact with the copy being fused. If care is not taken to keep the fuser roll free of toner particles, these toner particles can build up on the face of the fuser roll and degrade the quality of the fix by removing the fusing properties on the surface of the roll contacting the copy sheet and toner images. Furthermore, such unwanted toner particles can be released from the fusing roll upon its subsequent contact with the image to fuse toner particles to the copy sheet in non-imaged areas. A wick is generally used to dispense silicone oil by gravity on the external Teflon surface of the heated fuser roll by a pad overlying the heated fuser roll.

In one well-known fusing system, the reservoir for silicone oil is remote from the heated fuser roll. The wick must transport the oil from the reservoir to a heat-resistant pad overlying the fuser roll at a rate sufficient to keep a supply of fuser oil at the fuser roll at all times. In this fusing system, a layer of wicking material contacts an oil applicator roll which rotates in the silicone oil reservoir. This layer transports the oil to the pad engaging the heated fuser oil. This pad comprises felt impregnated with Teflon particles. The oil is transferred by gravity from the wicking layer to the pad and then to the fuser roll. A layer of wool was first commerically utilized in this system. The wool served as an adequate wick but scorched rather easily, which impaired its wicking properties. It was then decided to commercially adopt a heat-resistant wick, namely, a layer of Nomex material as a substitute for the wool wick. (Nomex is a trademark of E. I. Du Pont de Nemours and Company, Wilmington, Delaware, and designates a heat-resistant nylon, which is a copolymer of metaphenylenediamine and iso-phthaloyl chloride.) However, it has been found that on continuous long copy runs of a xerographic machine in which this fuser system is employed, the Nomex layer cannot transport the oil fast enough to keep the fuser roll adequately supplied with oil.

It is an object of this invention to provide the above-described fuser system with an improved wick wherein oil will be transported from the remote reservoir to the fuser roll at a rate to provide the fuser roll with an adequate supply of oil during long continuous copy runs.

Other objects of the invention will become apparent from the following description wherein.

Figure 1:
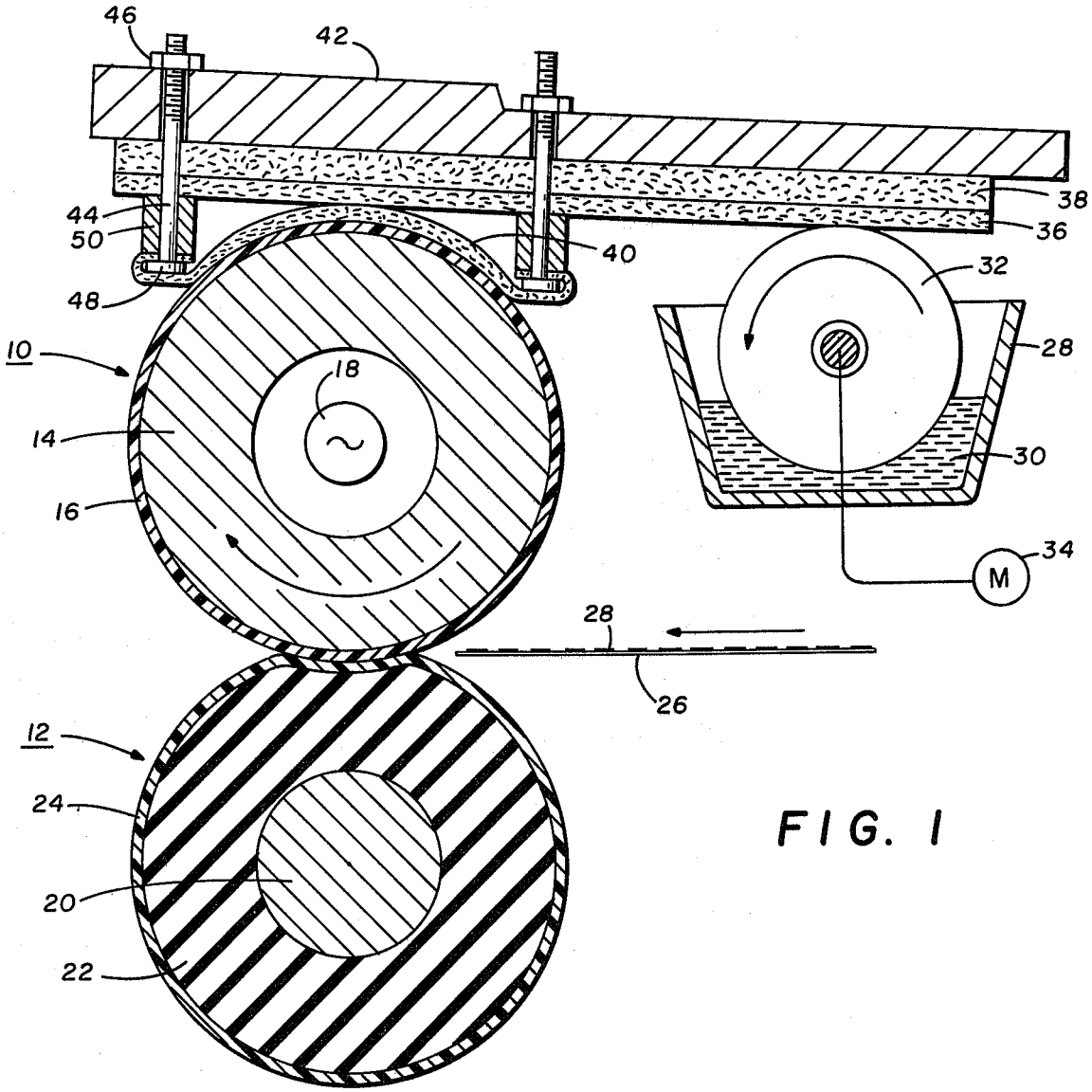
FIG. 1 is a side view of a heated pressure fusing system.

Referring to the FIG. 1, the fusing system comprises a heated fuser roll 10 and a backup roll 12. The fuser roll 10 is a hollow circular cylinder with a metallic core 14 and a Teflon layer 16. A lamp 18 serves as a source of thermal energy and is located at the center of the fuser roll. Power to the lamp is controlled by a thermal sensor generally called a thermistor contacting the periphery of the fuser roll as described, for example, in U.S. Pat. No. 3,357,249. The backup roll 12 is also a circular cylinder and is made up of a metal core 20 surrounded by a thick rubber layer 22 and also a Teflon layer 24 to prevent soaking silicone oil into rubber layer 22 and thereby subsequent swelling.

When the two rollers 10 and 12 are engaged as shown, the applied load deforms the rubber in the pressure roll to provide a nip with a finite width. A copy sheet 26 electrostatically bearing toner images 28 on one side thereof is brought into contact with the nip of the rolls with the toner image contacting the fuser roll 10. For a given temperature of the fuser roll, the fusing rate will depend upon the contact arc length of the support material against the dwell time, i.e., the time the toner image remains between the fuser roll 10 and the backup roll 12. Dwell time can be varied either by changing the surface velocity of the rolls or by varying the contact arc length and holding the speed of the roll the same. Contact arc length depends on the softness of the rubber on backup roll 12 and on the amount of pressure between the rolls 10 and 12. The mechanism for driving the rolls for lowering and raising the rolls into contact can be accomplished by any suitable means as that described, for example, in U.S. Pat. No. 3,291,466 or by a suitable mechanical camming device.

As a sheet of material is advanced between the rolls 10 and 12, the toner image on the support material will contact the peripheral heated surface of the roll 10 whereby the toner image becomes tackified and in this tackified condition, the toner will tend to offset on this roll except that it is partially prevented from doing so by the Teflon coating on the roll. An oil applicator assembly is used to apply a thin film of offsetting preventing liquid, such as silicone oil, to the Teflon surface 16 of the fuser roll 10 to additionally prevent offsetting of the toner onto the roll 10.

Figure 2A:
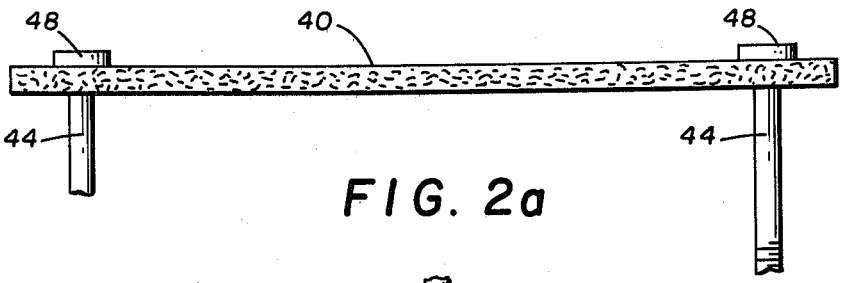
FIG. 2A is a view of a wiper pad with bolts extending therethrough.
Figure 2B:
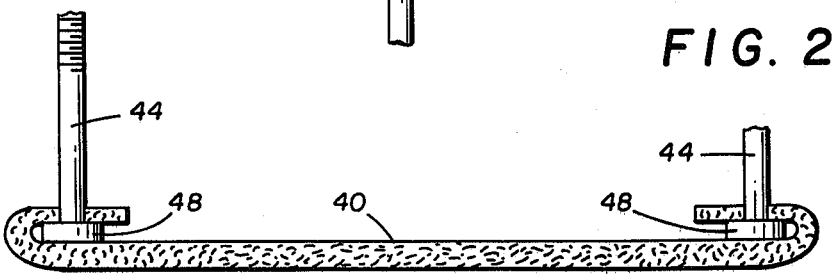
FIG. 2B is a view of the wiper pad having its ends folded over for assembly.

The oil applicator assembly comprises an oil reservoir housing 28 for maintaining a supply of silicone oil 30 and an applicator roll 32 rotatably mounted on the housing 28. The applicator roll 32 is driven by an oil dispenser motor 34 which is energized during the fusing operation depending upon the number of copies being produced. A wick assembly comprises a layer 36 of Nomex material, a layer 38 of wool material and a wiper pad 40 of felt material impregnated with Teflon (Teflon is a trademark or Du Pont Company and designates fluorocarbon polymers). The wiper pad 40 engages and conforms to the shape of fuser roll 10. The Nomex layer 36 engages the wiper pad 40 at one end and at the other end engages the applicator roll 32. The wool layer 38 engages the entire Nomex layer 36 and is secured thereto by a well-known needling process where needles are punched through both layers causing a mechanical interlock between the fibers of both layers. A weight 42 lies on top of the wool layer and is secured by bolt 44 and nut 46 assemblies to the wick assembly as shown in FIG. 1. The Teflon impregnated felt pad 40 is originally a flat pad. Bolts 44 are inserted through openings in the ends of the pad (see FIG. 2A), and then the ends are folded over (see FIG. 2B) whereby the heads 48 of the bolts reside inside of the folded ends. Referring to FIG. 1, each bolt 44 is then inserted through a spacer 50 and then through aligned openings in the Nomex and wool layers 36, 38 and through the weight 42. Nuts 46 are threaded onto the bolts 44 to secure the wick assembly to the weight 42. The wiper pad 40 is loose enough to conform to the fuser roll 10 and contact the bottom surface of the Nomex layer 36. The weight 42 is designed to be heavy enough to maintain the wiper pad 40 in contact with the fuser roll 10 and the Nomex layer 36 in contact with the applicator roll 32 but without interferring with the rotation of the rolls. The periphery of the fuser roll 10 extends slightly above the periphery of the applicator roll 32 whereby the end of the wick assembly at the fuser roll is at a higher level than the end of the wick assembly at the applicator. This causes the oil to wick upwards from the applicator to the fuser roll.

The wool layer 38 is better than the Nomex layer 36 as a transporting medium of oil since oil wicks through the wool layer 38 at a faster rate than through the Nomex layer. In a well-known commercial construction which is similar to the above-described construction, except without the Nomex layer 36, the wool layer scorched during long continuous runs. A Nomex layer was substituted for the wool layer and now it has been found that the Nomex layer does not always provide an ample supply of oil from the oil reservoir to the fuser roll during long continuous copy runs. However, the combination disclosed has eliminated these problems. The Nomex layer is utilized for its thermal stability at elevated temperatures to protect the wool layer 38 from scorching. Both the Nomex layer and the wool layer will wick oil to the fuser roll. However, the wool layer is used for its oil wicking characteristics to transport oil from the reservoir to the fuser roll at a sufficient rate to provide an ample supply of oil to the fuser roll during long continuous copy runs (when the Nomex layer fails to do so) by keeping the Nomex layer filled with oil. The oil permeates the wiper pad 40 by gravity to lubricate the fuser roll 10. The Teflon impregnated wiper pad is used for its excellent lubricating and heat-resistant characteristics.

What is claimed is:

1. In a heated pressure roll fusing system for fusing toner images, a wicking system comprising: an oil reservoir; a heated fuser roll; said reservoir being laterally displaced from said fuser roll; first, second and third members; said first member comprising a heat-resistant, self-lubricated wiper having one face engaging said fuser roll; said second member comprising a heat-resistant porous member of oil wicking characteristic extending between said fuser roll and said reservoir and having a portion of one face thereof engaging the other face of said wiper member; means for directly applying oil from said reservoir to another portion of said one face of said second member; said third member comprising a porous member of a substantially higher oil wicking characteristic and substantially less heat-resistant characteristic than said second member; said third member engaging the other face of said second member from the fuser roll to at least the portion of said second member to which oil is applied.

2. The structure as recited in claim 1 wherein said first member comprises a fluorocarbon polymer; said second member is a copolymer of meta-phenylenediamine and iso-phthaloyl chloride, and said third member is wool.

3. The structure as recited in claim 2 wherein said oil applying means is an applicator roll located to rotate in said oil reservoir and engages said another portion of said one face of said second member.

* * * * *